United States Patent [19]

Heitkamp et al.

[11] 4,412,758

[45] Nov. 1, 1983

[54] HYDRAULIC CONTROL MEANS

[75] Inventors: Herbert Heitkamp, Werne; Walter Hohn, Selm-Borke, both of Fed. Rep. of Germany

[73] Assignee: Gewerkschaft Eisenhutte Westfalia, Lunen, Fed. Rep. of Germany

[21] Appl. No.: 265,206

[22] Filed: May 19, 1981

[30] Foreign Application Priority Data

May 21, 1980 [DE] Fed. Rep. of Germany ..... 3019290

[51] Int. Cl.[3] ..... E21D 9/06; F15B 11/08

[52] U.S. Cl. ..... 405/145; 405/141; 91/420

[58] Field of Search ..... 405/138, 141, 142, 145; 299/31; 91/420, 451, 518, 531

[56] References Cited

U.S. PATENT DOCUMENTS

| | | | |
|---|---|---|---|
| 3,807,175 | 4/1974 | Kubik | 91/420 X |
| 4,020,867 | 5/1977 | Sumiyoshi | 91/420 X |
| 4,095,436 | 6/1978 | Heitkamp et al. | 405/145 X |
| 4,142,368 | 3/1979 | Mantegani | 91/420 X |
| 4,165,675 | 4/1979 | Cryder et al. | 91/420 |
| 4,224,004 | 9/1980 | Heitkamp | 405/145 |
| 4,287,812 | 9/1981 | Iizumi | 91/420 |

*Primary Examiner*—James A. Leppink

*Assistant Examiner*—Nancy J. Pistel

*Attorney, Agent, or Firm*—Thompson, Birch, Gauthier & Samuels

[57] ABSTRACT

A tunnel knife shield has a support frame, and a plurality of knives positioned side-by-side on the support frame. Each of the knives is associated with a double-acting hydraulic ram, the rams being used for advancing the knives, and for causing the support frame to follow up the advance of the knives. Hydraulic control means are provided for controlling the extension and retraction of the rams. Each ram has first and second working chambers, pressurization of which is effective to extend and retract that ram. The hydraulic control means comprises respective first supply lines for supplying pressurized hydraulic fluid to the first working chambers, respective second supply lines for supplying pressurized hydraulic fluid to the second working chambers, and respective discharge lines for discharging hydraulic fluid from the first working chambers. Each discharge line is provided with a flow-regulation valve and a pilot-operated non-return valve. The flow-regulation valves control the rate of retraction of the rams. The pilot lines of the non-return valves are connected to the associated second supply lines, so that these valves open automatically when the second working chambers are pressurized.

9 Claims, 3 Drawing Figures

HYDRAULIC CONTROL MEANS

BACKGROUND OF THE INVENTION

This invention relates to hydraulic control means for controlling the advance rams of a tunnelling knife shield.

Knife shields are used for forming tunnels, drifts, mine galleries, adits, trenches, and other elongate excavations. Typically, a knife shield has a plurality of knives (planks) positioned side-by-side, and supported on a common support frame. A double-acting hydraulic ram is positioned between each of the rams and the support frame. The knives are advanced, either singly or in groups, by extending their rams, the remaining, stationary knives forming (with the support frame) an abutment for such advance movement owing to their frictional contact with the surrounding earth of the tunnel walls. When all the knives have been advanced, the support frame is advanced, in a follow-up step, by simultaneously retracting all the rams, the frictional contact between the knives and the surrounding earth providing an abutment for this movement.

In order to prevent the support frame from assuming undesired inclined positions, or from tilting, during its follow-up movement (and to ensure that all the rams are provided with substantially the same amount of hydraulic fluid), it is known to provide such a knife shield with control means for synchronising the retraction of the rams. For this purpose, flow-regulation valves are fitted in the hydraulic lines leading to the ram working chambers. Unfortunately, the flow-regulation valves available for this purpose can be used only for working pressures up to about 300 bars. At pressures higher than about 300 bars, these flow-regulation valves are subjected to intolerably heavy wear, so that their use cannot be entertained. On the other hand, knife shields usually operate at considerably higher hydraulic working pressures (500 bars or more), so that sufficiently large forces are available for advancing the knives rapidly.

The aim of the invention is to provide hydraulic control means for a knife shield, which control means can effect synchronous control of the knife advance rams at operating pressures of 500 bars or more, and without the flow-regulation valves being subjected to these high working pressures.

SUMMARY OF THE INVENTION

The present invention provides hydraulic control means for controlling the advance rams of a tunnelling knife shield of the type having a plurality of knives positioned side-by-side on a support frame, the rams being positioned between the knives and the support frame, and each ram having a first and second working chambers pressurisation of which is effective to extend and retract that ram, the hydraulic control means comprising respective first supply lines for supplying pressurised hydraulic fluid to the first working chambers, respective second supply lines for supplying pressurised hydraulic fluid to the second working chambers, and respective discharge lines for discharging hydraulic fluid from the first working chambers, wherein each discharge line is provided with a flow-regulation valve for controlling the retraction rate of the associated ram, and wherein each discharge line is provided with a check valve which opens automatically when the second working chamber of the associated ram is supplied with pressurised hydraulic fluid, each of the check valves being disposed between the associated flow-regulation valve and the associated first working chamber.

Thus, with this form of hydraulic control means, the flow-regulation valves are isolated from the high working pressure which is applied to the first working chambers to advance the rams. Consequently, the knives of the tunnelling shield can be advanced rapidly under high working pressures, without the flow-regulation valves being exposed to these high working pressures. On the other hand, when the rams are to be retracted to cause the support frame to advance in a follow-up movement, the check valves automatically open, so that synchronous control of the retraction of the rams is achieved. Since, however, the flow-regulation valves are located in the discharge lines leading from the first working chambers, they are subjected to a pressure which is less than that applied to the second working chambers. This pressure reduction is proportional to the ratio of the areas of the first and second working chambers; the first working chambers being cylindrical and of larger area, and the second working chambers being annular and of smaller area. Consequently, both when extending the rams to advance the knives, and when retracting the rams to advance the support frame, it is possible to use hydraulic working pressure that are considerably higher than the maximum working pressure for which the flow-regulation valves are designed.

Advantageously, each of the discharge lines leads to a common return line, and each of the first supply lines is provided with a pilot valve, the pilot valves controlling the supply of pressurised hydraulic fluid to the first working chambers.

Preferably, each of the check valves is a pilot-operated non-return valve, the pilot line of which is connected to the associated second supply line. In this way, it is possible to provide a cheap and reliable synchronous control means suitable for high working pressures.

In a preferred embodiment, each of the second supply lines is provided with a pilot-operated non-return valve, the pilot line of which is connected to the associated first supply line, a respective pressure-relief valve being provided in parallel with each of said pilot-operated non-return valves. This arrangement prevents the knives from being extended accidentally, so that all the knives not being advanced are locked to the support frame. Similarly, it is impossible for the support frame to slide backwards in the shield when, as is usual for directional control purposes, a plurality of knives are advanced simultaneously. When a curve is being negotiated, because the stationary knives are locked to the support frame, the support frame can be reliably braced against the knives located at the outside of the curve, these knives being held stationary owing to their frictional contact with the surrounding earth of the tunnel wall. This ensures that, during directional control, the support frame moves in the required direction, under the effect of the reaction forces of the rams at the inside of the curve. The locking action preventing the extension of a given ram is automatically terminated by the associated pressure-relief valve when the first working chamber of that ram is pressurised. The pressure-relief valves thus limit the pressure in the second working chambers of the rams, whereas the check valves prevent ram extension when directional control of the shield is required.

In one preferred embodiment, a respective non-return valve is provided in parallel with each of the flow-regulation valves.

In another preferred embodiment, a respective non-return valve is provided in each of the first supply lines, each of the first supply lines being arranged so that said non-return valves are in parallel with the associated flow-regulation valves. In this case, each of the discharge lines may be provided with a further non-return valve disposed on the opposite side of the associated flow-regulation valve to the associated check valve, and each of the first-mentioned non-return valves may be parallel with the associated check valve, flow-regulation valve and further non-return valve.

The invention also provides a knife shield having a support frame, a plurality of knives positioned side-by-side on the support frame, a plurality of double-acting hydraulic rams for advancing the knives and for causing the support frame to follow up the advance of the knives, and hydraulic control means for controlling the extension and retension of the rams, the rams being positioned between the knives and the support frame, and each ram having first and second working chambers pressurisation of which is effective to extend and retract that ram, the hydraulic control means comprising respective first supply lines for supplying pressurised hydraulic fluid to the first working chambers, respective second supply lines for supplying pressurised hydraulic fluid to the second working chambers, and respective discharge lines for discharging hydraulic fluid from the first working chambers, wherein each discharge line is provided with a flow-regulation valve for controlling the retraction movement of the associated ram, and wherein each discharge line is provided with a check valve which opens automatically when the second working chamber of the associated ram is supplied with pressurised hydraulic fluid, each of the check valves being disposed between the associated flow-regulation valve and the associated first working chamber.

BRIEF DESCRIPTION OF THE DRAWINGS

A tunnel knife shield incorporating hydraulic control means constructed in accordance with the invention, will now be described, by way of example, with reference to the accompanying drawings, in which.

DESCRIPTION OF PREFERRED EMBODIMENTS

Figure 1:
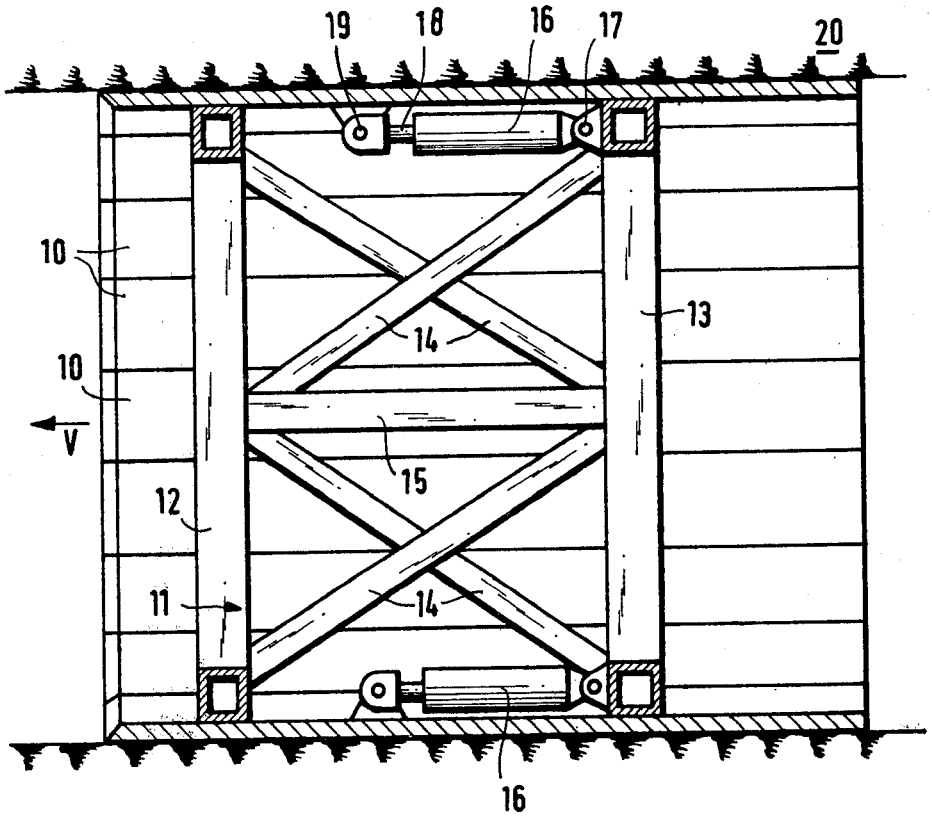
FIG. 1 is a diagrammatic longitudinal cross-section taken through the knife shield.

Referring to the drawings, FIG. 1 shows a knife shield for use in tunnelling, the knife shield having a plurality of knives (planks) 10 which are mounted in a side-by-side parallel relationship so as to define a cylindrical shell. The shell forms a protective shield within which the men and machines carrying out the tunnelling operations are protected. The shell may be open at the bottom, or it may form a closed, cylindrical jacket. The knives 10 are supported and guided upon a support frame 11 having two axially-spaced frame members 12 and 13 of box-girder construction. The frame members 12 and 13 are rigidly interconnected by means of diagonal and longitudinal struts 14 and 15 respectively.

Each of the knives 10 is provided with a double-acting hydraulic advance ram 16 for advancing that knife. The cylinders of the rams 16 are pivotally connected, by means of pivot joints 17, to the frame member 13; and the piston rods 18 of the rams are pivotally connected, by means of pivot joints 19, to the knives 10. The rams 16 can be charged with pressurised hydraulic fluid, either singly or in groups, so as to extend their piston rods 18. As a given ram 16 is extended, its cylinder is braced against the frame member 13 of the frame 11, so that the knife 10 associated with that ram is advanced in the direction of the arrow V. The frame 11 forms an abutment for this knife advance movement, because it is held stationary owing to the frictional contact between the other knives 10 and the earth 20 of the surrounding tunnel wall. The knives 10 are usually advanced one at a time and in succession. As soon as all the knives 10 have been advanced, the support frame is advanced, in a follow-up step, by simultaneously retracting all the rams 16. The frictional contact between the knives 10 and the earth 20 provides an abutment for the advance movement of the frame 11.

Figure 2:
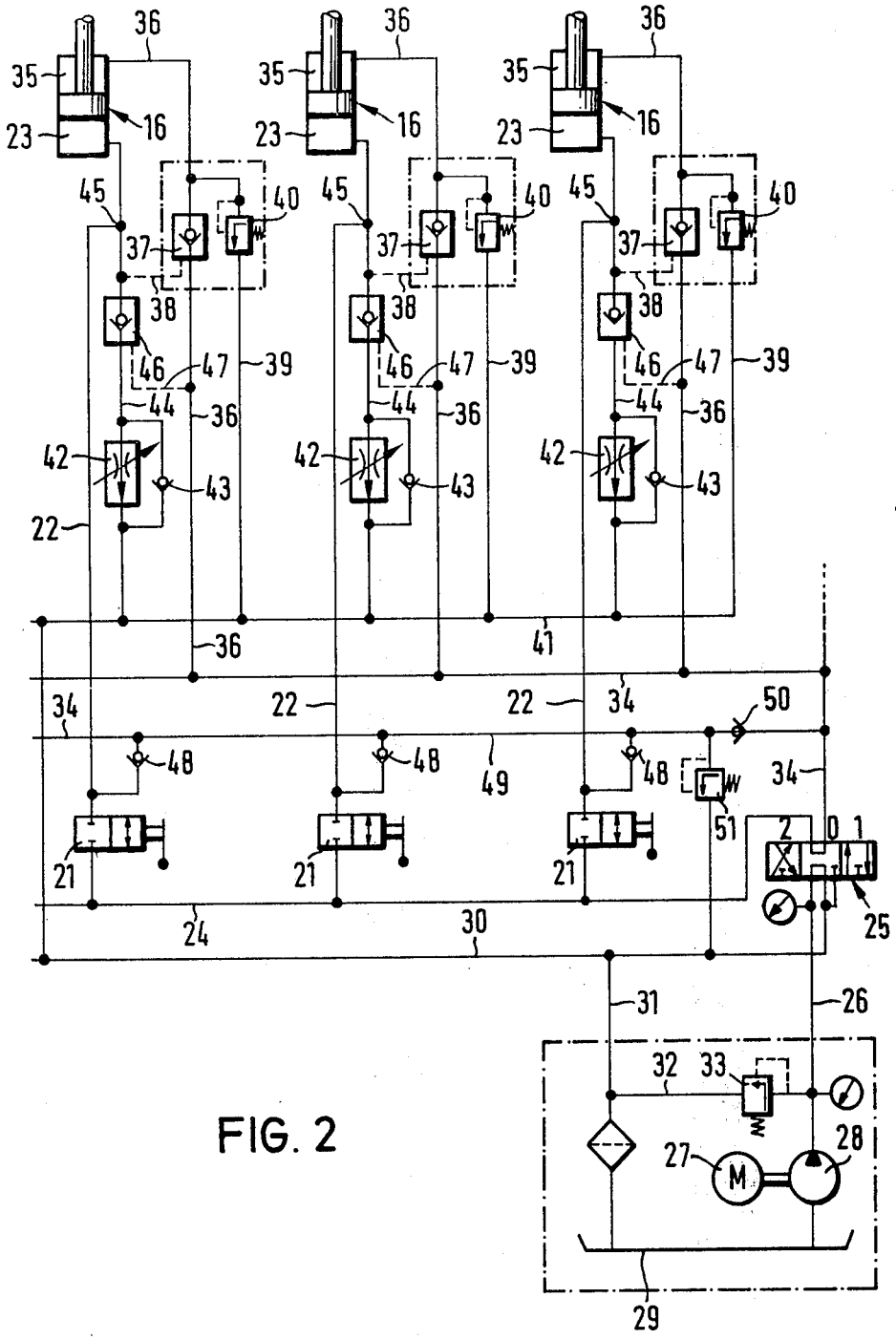
FIG. 2 is a circuit diagram showing a first form of hydraulic control means for controlling the knives of the knife shield.

FIG. 2 shows hydraulic control means for controlling the rams 16 of the knife shield described above. This figure shows how the hydraulic control means controls only three rams 16, but it will be appreciated that all the rams of the knife shield are controlled in a similar fashion.

A respective pilot valve 21 is associated with each of the rams 16, each of the pilot valves being actuable either manually or automatically from a remote position. The outlet of each pilot valve 21 is connected to a first working chamber 23 of the associated ram 16, via a respective line 22. The inlets of all the pilot valves 21 are connected, via a common line 24, to a first outlet of a control valve 25. The control valve 25 has three operating positions 1, 0 and 2. The control valve 25 has a first inlet which is connected to a supply line 26. The supply line 26 is connected to the outlet of a pump 28, which is driven by a motor 27. The pump 28 draws hydraulic fluid from a tank 29. The control valve 25 has second and third inlets connected to a common return line 30. The return line 30 is connected to the tank 29 via a line 31. A by-pass line 32, which contains a pressure-relief valve 33, is connected between the lines 26 and 31. The pump 28 is arranged to supply hydraulic fluid at a pressure of at least 500 bars.

The control valve 25 has a second outlet, which is connected to a line 34. The line 34 is connected, via respective lines 36, to second working chambers 35 of the rams 16. The first working chambers 23 of the rams 16 are cylindrical working chambers, and the second working chambers 35 are annular working chambers. Each of the lines 36 is provided with a respective pilot-operated non-return valve 37, the valves 37 being open for fluid flow in the "wrong" direction when their pilot lines 38 are pressurised (as is described below). A respective line 39 is arranged in parallel with each of the pilot-operated non-return valves 37, each line 39 being provided with a respective adjustable pressure-relief valve 40. The lines 39 are connected to the common return line 30, via a common line 41.

Each of the rams 16 is associated with a respective, adjustable, flow-regulation valve 42. Each flow-regulation valve 42 has a respective non-return valve 43 in parallel therewith, and is provided in a respective line 44. Each of the lines 44 is connected to the line 41 and, at 45, to the line 22 leading to the first working chamber 23 of the associated ram 16. A respective pilot-operated non-return valve 46 is provided in each of the lines 44 "upstream" of the corresponding flow-regulation valve 42. The valves 46 are open for fluid flow in the "wrong" direction, when their pilot lines 47 are pressurised (as is described below). Each of the pilot lines 47 is connected to the line 36 leading to the second working chamber 35 of the associated ram 16. The pilot lines 38 of the valves 37 are connected to the corresponding lines 44 "downstream" of the valves 46.

The outlets of all the pilot valves 21 are connected, via respective non-return valves 48, to a common line 49. The line 49 is connected, via a non-return valve 50, to the line 34. The line 49 is also connected, via a pressure-relief valve 51, to the common return line 30, the pressure-relief valve 51 being positioned "upstream" of the non-return valve 50. Thus, all the lines 22 are connected to the pressure-relief valve 51, via the non-return valves 48 and the line 49, so that impermissibly high pressure cannot build up in the working chambers 23 or the lines leading thereto.

The hydraulic control means described above operates in the following manner. When the control valve 25 is in the operating position 1, the line 24 is connected to the supply line 26. Then, by reversing the positions of the pilot valves 21 from the positions shown in FIG. 2, the first working chamber 23 of the rams 16 are supplied with pressurised hydraulic fluid, via the lines 22. In this way, the knives 10 can be advanced, either singly or in groups, in the direction V of tunnel advance. As a given knife 10 is advanced, the hydraulic fluid in its second working chamber 35 is expelled and forced along the line 36, along the line 34 and into the common return line 30. The associated pilot-operated non-return valve 37 is open to permit this to happen, the valve 37 having been opened since its pilot line 38 is connected to the associated line 22 which is pressurised. On the other hand, the associated flow-regulation valve 42 is cut-off from the associated pressurised line 22 by the associated pilot-operated non-return valve 46. This non-return valve 46 is closed, because its pilot line 47 is connected to the line 36. The line 36 is subject only to the low pressure of returning hydraulic fluid, this pressure being insufficient to open the valve 46. Consequently, the flow-regulation valve 42 is not exposed to the high pressure obtaining in the associated first working chamber 23.

In order to advance the support frame 11, in a follow-up step after all the knives 10 have been advanced, the second working chambers 35 of the rams 16 are simultaneously pressurised. For this purpose, the control valve 25 is brought into the operating position 2, in which the line 34 is connected to the supply line 26. Pressurised hydraulic fluid then flows along all the lines 36, through the non-return valves 37, and into the second working chambers 35 of the rams 16, thereby retracting the rams. The hydraulic fluid expelled from the first ram working chambers 23 as a result of the retraction of the rams 16, flows into the common return line 30, via the lines 44, the pilot-operated non-return valves 46, the flow-regulation valves 42 and the lines 41. The non-return valves 46 are open to permit this to happen, the valves 46 having been opened since their pilot lines 47 are connected to the associated lines 36 which are pressurised. Since the area of the annular working chambers 35 is less than that of the cylindrical working chambers 23 (owing to the piston rods passing through the annular working chambers), the pressure of hydraulic fluid in the chambers 23 is less than that in the chambers 35 during ram retraction. This reduction in pressure is proportional to reduction ratio of the areas of the chambers 23 and 35. Thus, the flow-regulation valves 42 are subjected only to this reduced working pressure, and not to the full working pressure of the pump 28. In other words, by positioning the flow-regulation valves 42 in return lines 44 leading away from the rams 16, the support frame 11 can be advanced in a follow-up step using the full working pressure of the pump 28, without the flow-regulation valves 42 being subjected to this pressure. It will be understood that, during the follow-up advance movement of the support frame 11, the pilot valves 21 are closed (as shown in FIG. 2).

The hydraulic control means described above could be modified by omitting the valves 37 and 40. Where the valves 37 and 40 are provided, however, they can be used to effect a hydraulic locking action between, for example, the support frame and the knives 10 at the outside of a curve to be negotiated by the shield. This enables the support frame 11 to assume an inclined position, which is necessary for negotiating curves, by advancing only the knives 10 at the inside of the curve.

The hydraulic control means could also be modified so that individual knives 10 could be retracted, for example, in the event of an obstacle being in the path of a given knife. In this case, suitable pilot valves would be arranged in the lines leading to the annular working chambers 35 (or in the lines leading from the cylindrical working chambers 23), these pilot valves permitting differential retraction of individual rams 16.

Figure 3:
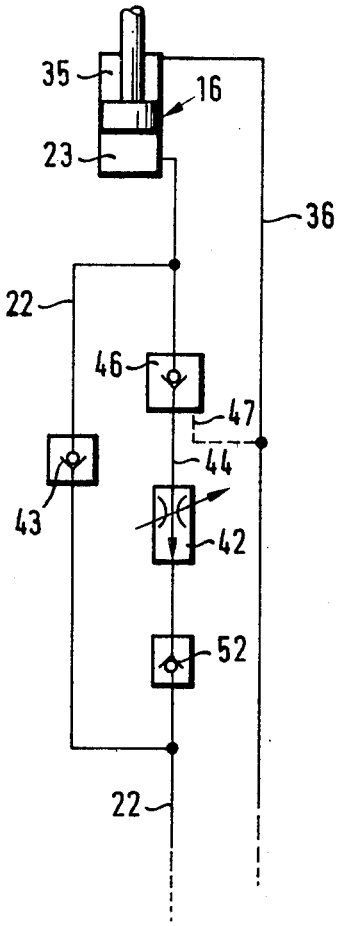
FIG. 3 is a circuit diagram showing a second form of hydraulic control means for controlling the knives of the knife shield.

FIG. 3 shows part of a modified form of hydraulic control means for controlling one of the hydraulic rams 16 of the knife shield described above. The main difference between this form of control means and that described above with reference to FIG. 2 is that the non-return valve 43, which bridges the flow-regulation valve 42, is here arranged in the line 22. Moreover, the flow-regulation valve 42 is in series with the pilot-operated non-return valve 46, both of these valves being parallel to the line 22 (in the line 44). The flow-regulation valve 42 is protected, from the high pressure in the line 22, by a further non-return valve 52, so that only hydraulic fluid discharged (at a relatively low pressure) from the working chamber 23 can flow along the line 44. Here again, therefore, the flow-regulation valves 42 are not subjected to the full pump pressure during the follow-up advance movement of the support frame 11, and this is advantageous as regards the precision of the setting of the flow-regulation valves.

We claim:

1. Hydraulic control means for controlling the advance rams of a tunnelling knife shield of the type having a pluraity of knives positioned side-by-side on a support frame, the rams being positioned between the knives and the support frame, and each ram having first and second working chambers pressurisation of which is effective to extend and retract that ram, the hydraulic control means comprising respective first supply lines for supplying pressurised hydraulic fluid to the first working chambers, respective second supply lines for supplying pressurised hydraulic fluid to the second working chambers, and respective discharge lines for discharging hydraulic fluid from the first working chambers, wherein each discharge line is provided with a flow-regulation valve for controlling the retraction rate of the associated ram, and wherein each discharge line is provided with a pilot-operated check valve, the pilot line of which is connected to the second working chamber of the associated ram so that said check valve opens automatically when said second working chamnber is supplied with pressurised hydraulic fluid, each of the check valves being disposed between the associated flow-regulation valve and the associated first working chamber.

2. Hydraulic control means according to claim 1, wherein each of the discharge lines leads to a common return line.

3. Hydraulic control means according to claim 1, wherein each of the first supply lines is provided with a pilot valve, the pilot valves controlling the supply of pressurised hydraulic fluid to the first working chambers.

4. Hydraulic control means according to claim 1, wherein the pilot line of each pilot-operated non-return valve is connected to the second working chamber of the associated ram via the associated second supply line.

5. Hydraulic control means according to claim 1, wherein each of the second supply lines is provided with a pilot-operated non-return valve, the pilot line of which is connected to the associated first supply line, a respective pressure-relief valve being provided in parallel with each of said pilot-operated non-return valves.

6. Hydraulic control means according to claim 1, wherein a respective non-return valve is provided in parallel with each of the flow-regulation valves.

7. Hydraulic control means according to claim 1, wherein a respective non-return valve is provided in each of the first supply lines, each of the first supply lines being arranged so that said non-return valves are in parallel with the associated flow-regulation valves.

8. Hydraulic control means according to claim 7, wherein each of the discharge lines is provided with a further non-return valve disposed on the opposite side of the associated flow-regulation valve to the associated pilot-operated check valve, and wherein each of the first-mentioned non-return valves is in parallel with the associated pilot-operated check valve, flow-regulation valve and further non-return valve.

9. A knive shield having a support frame, a plurality of knives positioned side-by-side on the support frame, a plurality of double-acting hydraulic rams for advancing the knives and for causing the support frame to follow up the advance of the knives, and hydraulic control means for controlling the extension and retension of the rams, the rams being positioned between the knives and the support frame, and each ram having first and second working chambers pressurisation of which is effective to extend and retract that ram, the hydraulic control means comprising respective first supply lines for supplying pressurised hydraulic fluid to the first working chambers, respective second supply lines for supplying pressurised hydraulic fluid to the second working chambers, and respective discharge lines for discharging hydraulic fluid from the first working chambers, wherein each discharge line is provided with a flow-regulation valve for controlling the retraction movement of the associated ram, and wherein each discharge line is provided with a pilot-operated check valve, the pilot line of which is connected to the second working chamber of the associated ram so that said check valve opens automatically when said second working chamber is supplied with pressurised hydraulic fluid, each of the check valves being disposed between the associated flow-regulation valve and the associated first working chamber.

* * * * *